US007007789B2

(12) United States Patent
Singleton, III

(10) Patent No.: US 7,007,789 B2
(45) Date of Patent: Mar. 7, 2006

(54) SECURITY COVER FOR VENDING MACHINE BILL VALIDATOR

(76) Inventor: Eugene G. Singleton, III, 33 Blair St., Greenville, SC (US) 29607

( * ) Notice: Subject to any disclaimer, the term of this patent is extended or adjusted under 35 U.S.C. 154(b) by 274 days.

(21) Appl. No.: 10/621,166

(22) Filed: Jul. 15, 2003

(65) Prior Publication Data

US 2005/0011723 A1 Jan. 20, 2005

(51) Int. Cl.
*G07F 1/00* (2006.01)
*G07F 9/10* (2006.01)

(52) U.S. Cl. ..... 194/351

(58) Field of Classification Search ..... 194/351, 194/350, 202; 221/282; 220/730; 232/43.2; 292/289; 109/66, 49.5; 235/379, 130 R; 52/220.8, 238.1, 5; 16/402, 404; 70/77, 70/78, 158, 443, 448, 450
See application file for complete search history.

(56) References Cited

U.S. PATENT DOCUMENTS 4,418,551 A * 12/1983 Kochackis ..... 70/18
5,222,584 A 6/1993 Zouzoulas ..... 194/207
5,495,929 A 3/1996 Batalianets ..... 194/207
5,709,159 A * 1/1998 Mercer et al. ..... 109/2
5,730,271 A 3/1998 Buchman ..... 194/206
5,964,336 A 10/1999 Itako ..... 194/207
6,457,586 B1 10/2002 Yasuda ..... 209/534
6,755,053 B1 * 6/2004 Dias ..... 70/14
6,769,569 B1 * 8/2004 Yu ..... 221/154

* cited by examiner

*Primary Examiner*—Donald P. Walsh
*Assistant Examiner*—Mark J. Beauchaine
(74) *Attorney, Agent, or Firm*—McNair Law Firm, P.A.

(57) ABSTRACT

A plate for attachment to an interior side of the housing of a vending machine to overlie the bill validator. The plate including a mask portion protruding to an exterior of the housing for covering a mouth portion of the bill validator exposed to the public. The mask portion includes an entrance aligned with a bill slot in the mouth portion of the bill validator. A bill passageway defined by a first guide flange and a second guide flange is disposed between the bill slot and the entrance for directing bills into an out of the bill validator. The guide flanges terminate in the mouth portion of the bill validator so that bills may reliably pass from the entrance through the bill passageway into the bill slot, and from the bill slot outwardly through the bill passageway to the entrance during bill rejection.

16 Claims, 6 Drawing Sheets

SECURITY COVER FOR VENDING MACHINE BILL VALIDATOR

FIELD OF THE INVENTION

The present invention relates to the protection of currency validators in vending machines accessible by the public and, more particularly, to a security cover for bill validators used on such vending machines to prevent the bill validators from being broken into and the money removed.

BACKGROUND OF THE INVENTION

Vending machines, such as for soft drinks, snacks, and the like, are often located outside and intended to be readily accessible to the public in stores and on the street. As the price of bottled beverages and snacks has increased, the use of bill validators on vending machines has become more widely used. The bill validators include a wide slot for entry of the bill, and for return of the bill if it is placed in the changer incorrectly or if the validator fails to identify and accept the bill as a valid bank-note. This wide mouth is susceptible to entry by a crowbar and being easily pried off so that access to the bills carried in the bill validator can be had. The problem of theft from bill validators and damaged bill validators depends, of course, on the location of the changers. However, many of the vending machines with bill validators are in locations clearly susceptible to theft. An experienced thief does not take long to break into an unprotected bill validator. The response to solving the problem has been largely to remove the vending machine from the location if it has been broken into more than twice, or to place a plate over the bill validator to render it completely inoperable to avoid further damage and theft. In the latter case, only coins can be used on the vending machine. Placing the machine in condition to only operate with coins typically reduces the profit from the machine by 30–40%.

The prior art is replete with bill validators of various designs, none of which are provided with protection sufficient to withstand an assault from a thief with a crowbar. For example, U.S. Pat. No. 5,964,336 shows a bill validator with a lid portion covering the internal workings of the validator which includes a bill slot for receiving and returning bills. No protection is provided to cover the bill slot and protect the bill validator. U.S. Pat. No. 5,730,271 shows a security box for a bill validator that includes a lid with a bill feed mouth for receiving and returning bills. Again, no separate protective cover is provided. U.S. Pat. No. 5,495,929 shows an apparatus for validating bank-notes that includes an unprotected bill receptor. U.S. Pat. No. 5,222,584 shows another type of currency validator with an unprotected bill entryway.

The prior art has not provided adequate security for protecting a bill validator from a thief with a crowbar. Accordingly, protecting bill validators on vending machines accessible by the public at all hours remains a problem which needs considerably attention.

Accordingly, it is an object of the present invention to provide a security cover for bill validators used on vending machines to prevent the bill validators from being broken into and the money removed.

It is an object of the present invention to provide a security cover for bill validators attached in such a manner as to prevent the removal of the security cover from the vending machine.

It is an object of the present invention to provide a security cover for bill validators adapted to allow bills to be inserted and returned through the security cover without becoming jammed between the bill validator and security cover.

SUMMARY OF THE INVENTION

The above objectives are accomplished according to the present invention by providing a security cover for protecting a bill validator of a vending machine wherein the security cover comprises an elongated plate for attachment to a housing of the vending machine to cover the bill validator. A mask portion of the security cover is provided for covering a bill slot of the bill validator. The mask portion has an entrance aligned with the bill slot for receiving and returning bills. A bill passageway is also aligned with the bill slot and the entrance of the mask portion. The bill passageway is defined by a first guide flange and a second guide flange spaced apart and carried between the bill slot and the entrance. The guide flanges terminating at a mouth portion of the bill validator around the bill slot and are constructed and arranged relative to the bill slot so that bills may reliably pass from the entrance through the bill passageway into the bill slot, and from the bill slot outwardly through the bill passageway to the entrance during bill rejection;

Advantageously, the first guide flange is preferably contoured upward and the second guide flange is preferably contoured downward from said entrance to said bill slot so that bills rejected from the bill validator that do not extend directly out from the bill slot are deflected by the flanges through the bill passageway to the entrance to prevent bills from lodging between the plate and the bill validator.

To help prevent removal of the security cover plate, tamper resistant fasteners are used for affixing the plate to an interior surface of the housing so that the fasteners are not exposed to the public. Additionally, the plate preferably has a height and width at least equal to the bill validator for protecting the bill validator from attempts to access the bill validator by breaking through the housing.

As a result, the bill validator of the vending machine is protected from vandalism and theft, while allowing continued operation of the bill validator.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF A PREFERRED EMBODIMENT

Figure 1:
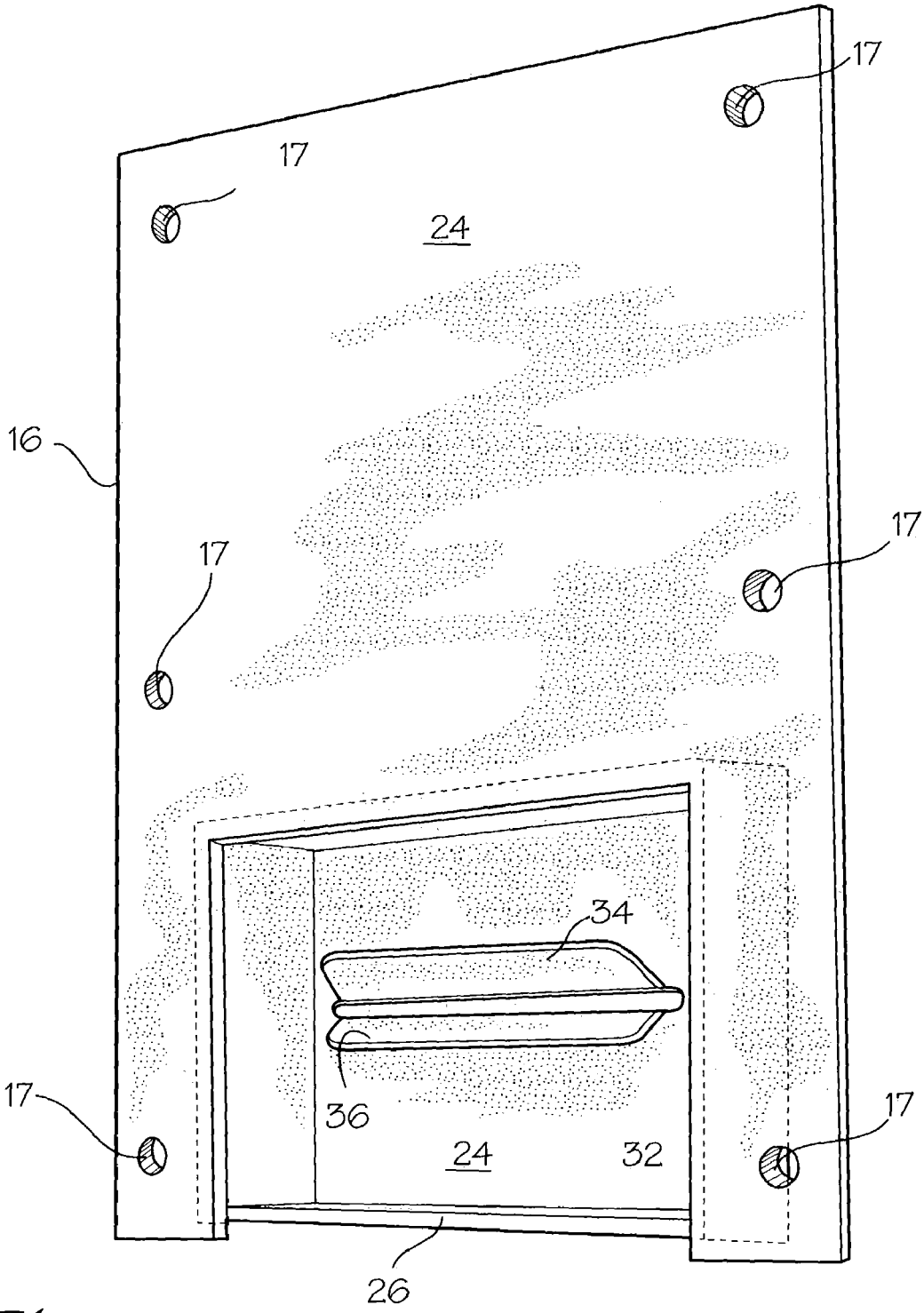
FIG. 1 shows a perspective view of the rear side of the security cover according to the invention.

With reference to the drawings, the invention will now be described in more detail. Referring to FIG. 1, a security cover, designated generally as A, is shown for attachment to a vending machine, designated generally as 12 (FIG. 2) that dispenses soft drinks, snacks, and the like. Security cover A is intended to protect the vending machine's bill validator, designated generally as 14 (best shown in FIG. 4), from theft and vandalism. Current bill validators on vending machines are susceptible to theft and vandalism achieved by prying or smashing the bill validators open with a crowbar, and then reaching into the bill validators to remove the bills. The invention provides a separate durable tamper resistant security cover to protect the entire bill validator from vandalism and theft.

Figure 4:
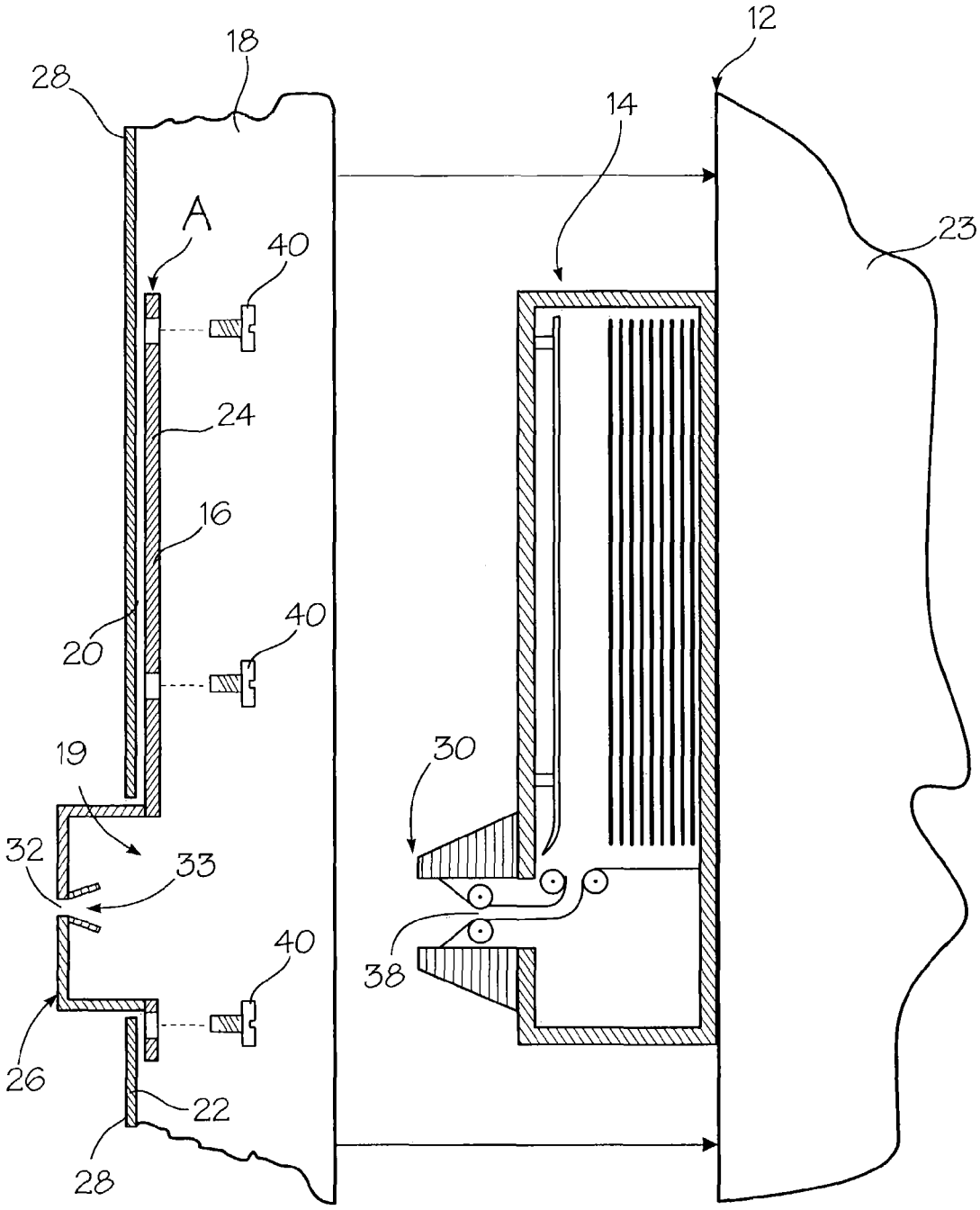
FIG. 4 shows an exploded cross-section side view of the security cover and associated bill validator according to the invention.

Referring to FIGS. 1 and 4, security cover A is shown in the preferred embodiment to be an elongated plate 16 of generally rectangular construction. Preferably, plate 16 is made of metal or other durable tamper resistant material capable of withstanding sever impacts and prying. Plate 16 includes a series of mounting holes 17 around the perimeter of plate 16 for receiving fasteners to attach the plate to vending machine 12 in a manner overlying and covering bill validator 14. Plate 16 is defined as having a front side 20 and a rear side 24.

Generally, vending machine 12 includes a front door 18 pivotally carried by a cabinet 23 which holds the drinks or other items. Bill validator 14 is typically carried by cabinet 23 with a portion extending through front door 18 to provide access to the public for inserting bills. In order to replenish items in the vending machine and legitimately remove bills from the bill validator, a vendor must unlock and open front door 18. Most advantageously, security cover A is flush mounted to an inside surface 22 of front door 18 adjacent bill validator 14 so that when the front door is closed, the bill validator is covered to prevent direct access by the public to the bill validator or fasteners attaching the security cover to the front door. Also, in alternative arrangements, tamper resistant fasteners can be used to mount the security cover to both the inside and outside of door 18 to prevent removal.

Figure 2:
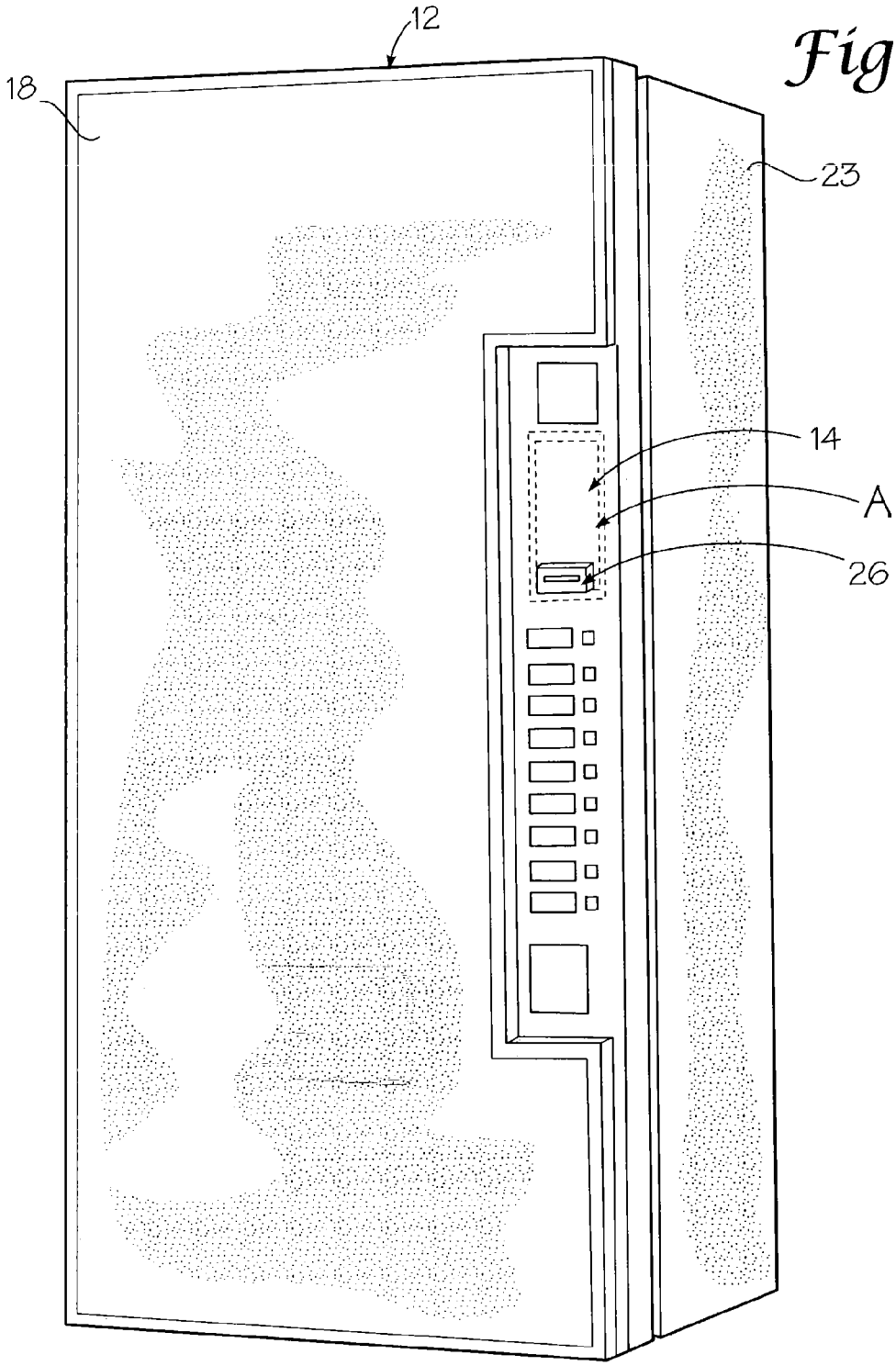
FIG. 2 shows a front view of the security cover on a vending machine according to the invention.
Figure 3:
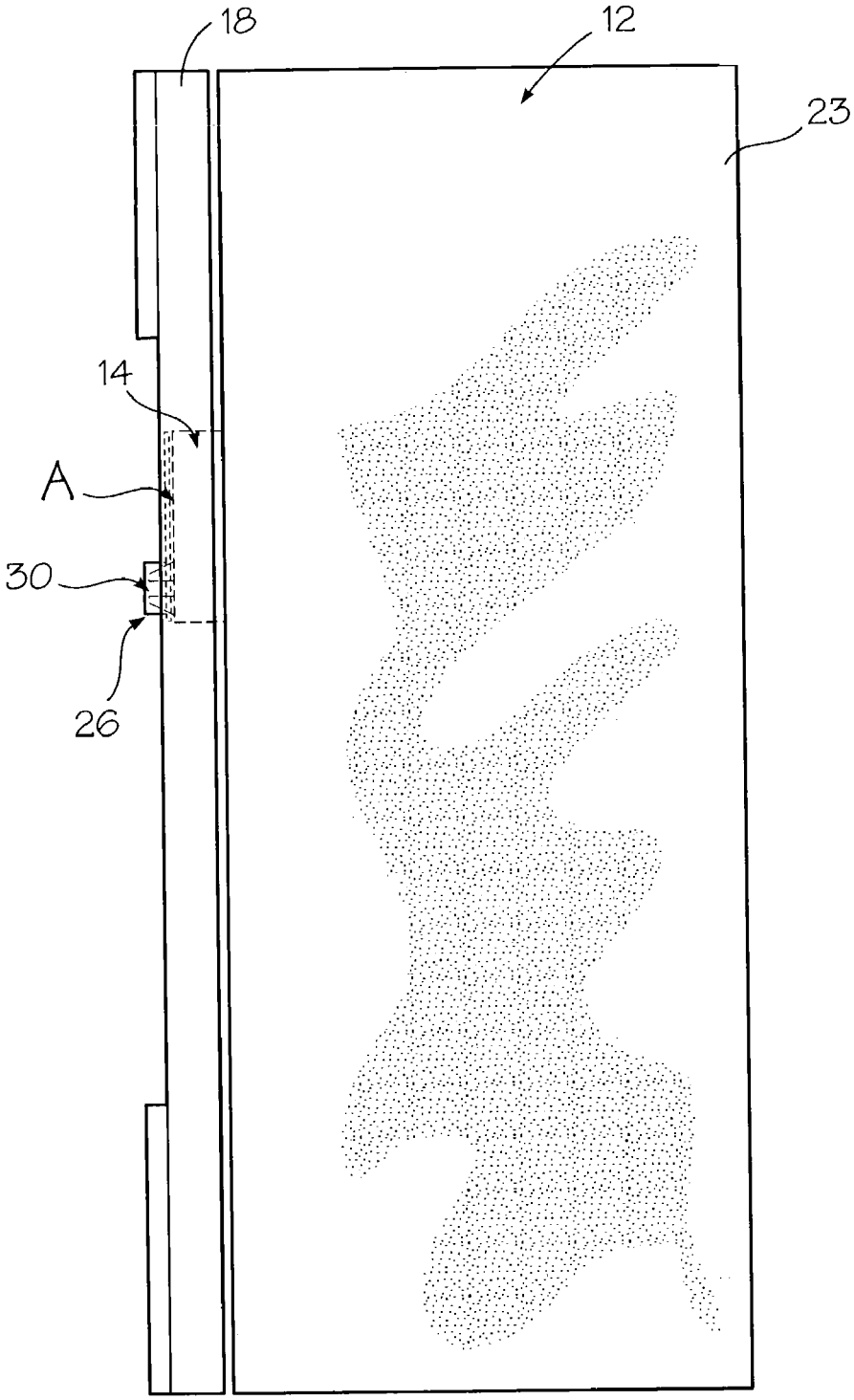
FIG. 3 shows a side view of the security cover on a vending machine according to the invention.

Referring to FIGS. 2–4, in the preferred embodiment, bill validator 14 is carried by cabinet 23 so that when front door 18 is closed against cabinet 23, a mouth portion, designated generally as 30, of bill validator 14 extends through a door opening, designated generally as 19, of front door 18 to provide access to the bill validator by the public. Front side 20 of security cover A is positioned facing interior surface 22 of front door 18. Accordingly, rear side 24 is positioned facing bill validator 14 when mounted to front door 18. Advantageously, tamper resistant fasteners 40 may be used for affixing plate 16 to interior surface 22 of front door 18, so that access cannot be had to the fasteners from the exterior of the vending machine, and access to the bill validator or otherwise tampering with security cover A is prevented. In an alternative arrangement, security cover A may be affixed to exterior 28 of front door 18 to cover mouth portion 30 using any number of appropriate tamper resistant fasteners commonly known to one skilled in the art.

Referring to FIG. 1, a mask portion, designated generally as 26, is included in plate 16 for cover mouth portion 30 of bill validator 14. In the preferred embodiment illustrated in FIGS. 5 and 6, security cover A is mounted to interior surface 22 of front door 18 with mask portion 26 extending through door opening 19 (FIG. 4) in front door 18. Mask portion 26 is constructed and arranged to cover mouth portion 30 of bill validator 14 so that the otherwise exposed mouth portion of the bill validator is protected by the mask portion of the security cover. Thus, a thief is prevented from using a crowbar, and the like, to strike and pry open the bill validator to steal the money inside.

Figure 5:
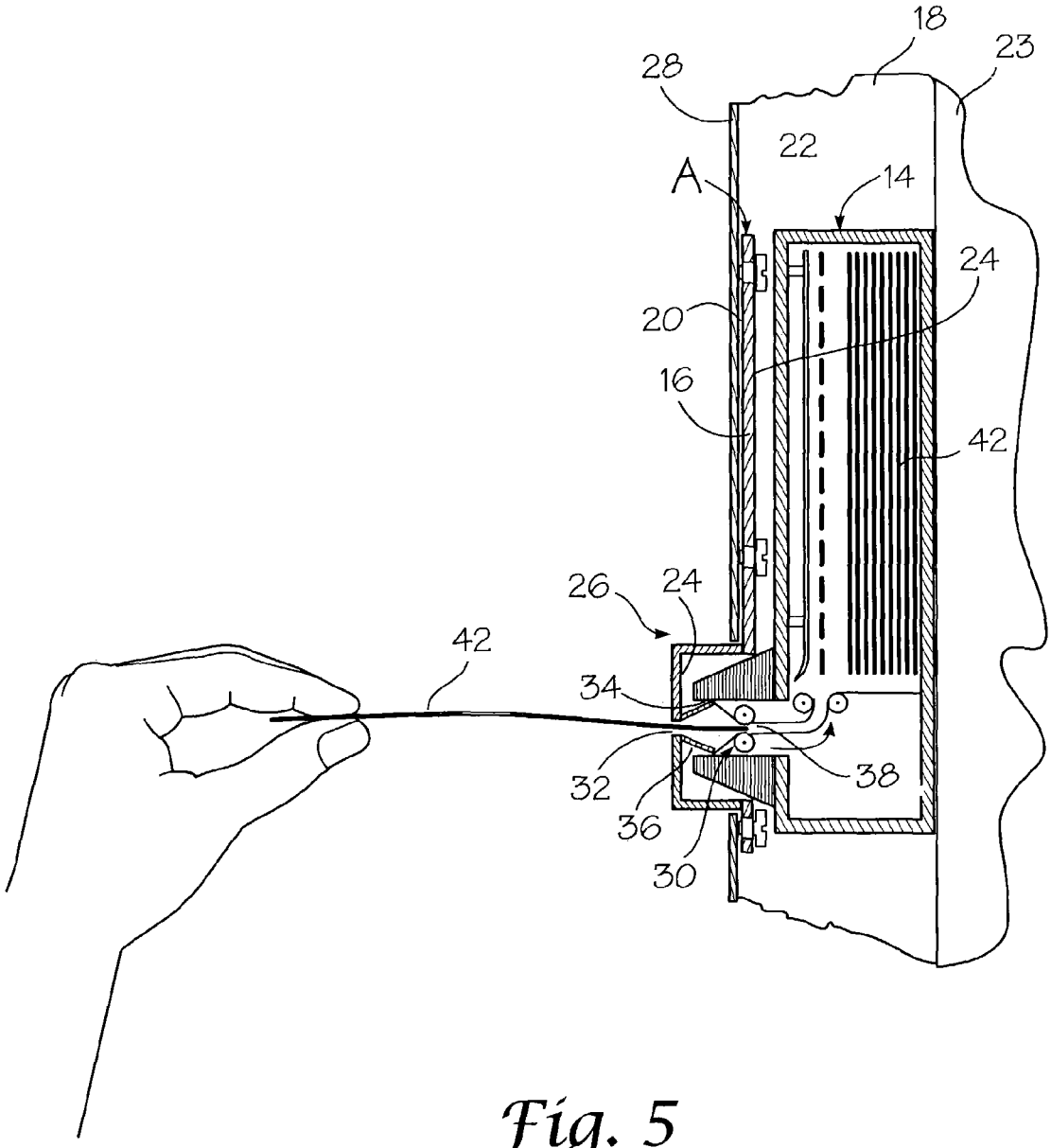
FIG. 5 shows a cross-section side view of the security cover in position over the bill validator receiving a bill according to the invention; and, FIG. 6 shows a cross-section side view of the security cover in position over the bill validator returning a bill according to the invention.

Referring to FIG. 1, a bill entrance 32 is included in mask portion 26 for allowing bills to pass through the security cover to the bill validator, and from the bill validator outwardly through the entrance when a bill is rejected. Referring to FIG. 5, entrance 32 is aligned with a bill slot 38 disposed in mouth portion 30 of bill validator 14 so that when a bill 42 is inserted through entrance 32, the bill is received in bill slot 38 for validation by the bill validator processes.

Figure 6:
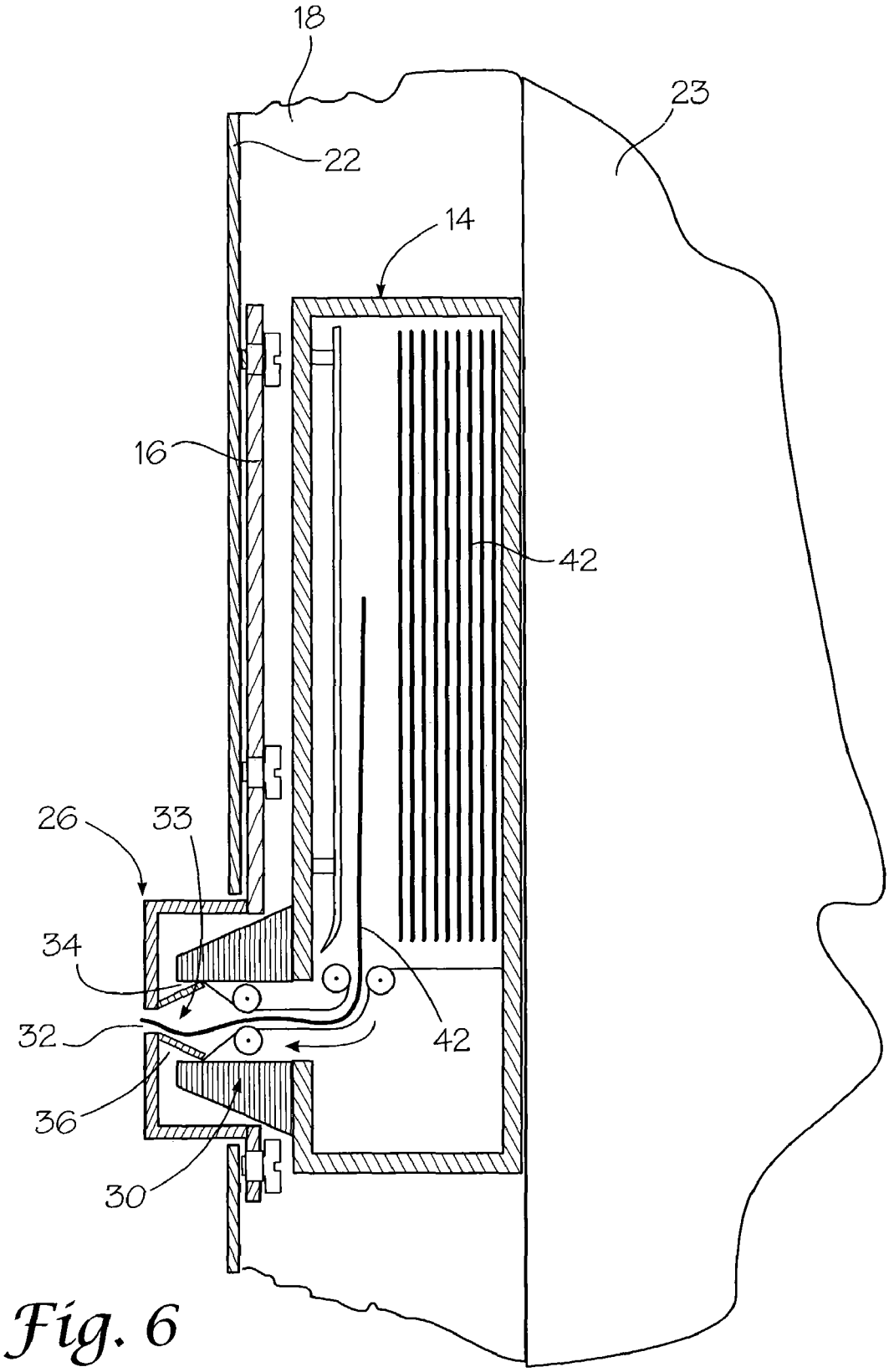

Referring to FIGS. 1 and 4, to ensure the proper passage of bills between the security cover and the bill validator, a bill passageway, designated generally as 33, is defined by a first guide flange 34 and a second guide flange 36 spaced apart entrance 32 and carried on rear side 24 of plate 16 in mask portion 26. Guide flanges 34 and 36 border the top and bottom sides of entrance 32, as best shown in FIG. 1. Referring to FIGS. 5 and 6, guide flanges 34 and 36 are constructed and arranged relative to bill slot 38 for terminating in mouth portion 30 of bill validator 14 so that bills may reliably pass through entrance 32 into bill slot 38, and from bill slot 38 outwardly through bill passageway 33 to entrance 32 during bill rejection.

Referring to FIG. 6, to ensure the bills pass properly through security cover A when rejected back through bill passageway 33 in the event the bill is not properly validated, first guide flange 34 is contoured upward and second guide flange 36 is contoured downward to provide a wide opening between the guide flanges for receiving and channeling bill 42 through bill passageway 33 to entrance 32. As shown in FIG. 6, bills rejected from bill validator 14 that are bent and otherwise do not extend directly out from bill slot 38 are deflected by flanges 34 and 36 through bill passageway 33 to entrance 32 to prevent bills from lodging between plate 16 and bill validator 14. Alternatively, depending on the make and model of the bill validator and vending machine, guide flanges 34 and 36 may be arranged to fit around mouth portion 30 to channel bills into entrance 32, or otherwise extend in such a manner as to guide a bill from entrance 32 to bill slot 38. Additionally, mask portion 26 may not be required to protrude as illustrated depending on the make and model of the bill validator and vending machine, but rather, plated 16 may align flat against front door 18 over door opening 19 and simply include bill entrance 32 aligned in front of mouth portion 30 of bill validator 14 with guide flanged 34 and 36 constructed and arranged as described above.

Referring to FIG. 2, security cover A has a width slightly larger than bill validator 14 for protecting the bill validator from attempts to access the bill validator by breaking through front door 18. Additionally, referring to FIG. 3, security cover A has a height at slightly taller than bill validator 14 for protecting the bill validator from attempts to access the bill validator by breaking through the housing.

While a preferred embodiment of the invention has been described using specific terms, such description is for illustrative purposes only, and it is to be understood that changes and variations may be made without departing from the spirit or scope of the following claims.

What is claimed is:

1. In combination, a vending machine having a bill validator and a security cover for protecting the bill validator comprising:

a vending machine having a housing;

a bill validator carried in said housing having a bill slot accessible to the public for receiving and returning bills;

a security cover carried by said housing overlying said bill validator;

a mask portion of said security cover covering said bill slot of said bill validator and having an entrance aligned with said bill slot for receiving and returning bills;

a bill passageway aligned with said bill slot and said entrance of said mask portion defined by a first guide flange and a second guide flange spaced apart and carried between said bill slot and said entrance; and, said guide flanges terminating at a mouth portion of said bill validator around said bill slot and being constructed and arranged relative to said bill slot so that bills may reliably pass from said entrance through said bill passageway into said bill slot, and from said bill slot outwardly through said bill passageway to said entrance during bill rejection;

whereby said bill validator is protected from vandalism and theft by said security cover and allows for continued operation of the bill validator.

2. The apparatus of claim 1 wherein said first guide flange is contoured upward and said second guide flange is contoured downward from said entrance to said bill slot so that bills rejected from said bill validator that do not extend directly out from said bill slot are deflected by said guide flanges through said bill passageway to said entrance to prevent bills from lodging between said security cover and said bill validator.

3. The apparatus of claim 1 including tamper resistant fasteners for affixing said security cover to an interior surface of said housing to prevent access to said fasteners by the public.

4. The apparatus of claim 1 wherein said security cover has a height at least equal to said bill validator for protecting said bill validator from attempts to access said bill validator by breaking through said housing.

5. The apparatus of claim 1 wherein said security cover has a width at least equal to said bill validator for protecting said bill validator from attempts to access said bill validator by breaking through said housing.

6. In combination, a vending machine having a bill validator and a security cover for protecting the bill validator comprising:

a vending machine having a housing;

a bill validator carried in said housing having a bill slot accessible to the public for receiving and returning bills;

a security cover carried by said housing overlying said bill validator;

a mask portion of said security cover covering said bill slot of said bill validator and having an entrance for feeding and returning bills to and from said bill validator;

a bill passageway disposed between said bill slot and said entrance constructed and arranged relative to said bill slot and said entrance for directing the passage of bills so that bills may reliably pass from said entrance through said bill passageway into said bill slot for bill acceptance, and from said bill slot through said bill passageway outwardly through said entrance during bill rejection;

whereby said bill validator is protected from vandalism and theft while allowing for continued operation of the bill validator.

7. The security cover of claim 6 wherein said bill passageway includes a first guide flange and a second guide flange extending between said security cover and said bill validator; said first guide flange being contoured upward and said second guide flange being contoured downward from said entrance to said bill slot so that bills rejected from said bill validator that do not extend directly out from said bill slot are deflected by said flanges through said bill passageway to said entrance to prevent bills from lodging between said plate and said bill validator.

8. The security cover of claim 6 including tamper resistant fasteners for affixing said security cover to said interior surface of said housing to prevent access to said fasteners by the public.

9. The security cover of claim 6 wherein said security cover has a height at least equal to said bill validator for protecting said bill validator from attempts to access said bill validator by breaking through said housing.

10. The security cover of claim 6 wherein said security cover has a width at least equal to said bill validator for protecting said bill validator from attempts to access said bill validator by breaking through said housing.

11. A security cover for vending machine bill validators comprising:

a plate having a front side and a rear side for attachment to a housing of said vending machine adjacent said bill validator;

a entrance included in said plate for aligning with a bill slot of said bill validator when mounted to said housing to insert bills into said bill validator;

a bill passageway carried on said rear side of said plate being constructed and arranged relative to said bill slot for terminating in a mouth portion of said bill validator around said bill slot when mounted to said housing so that bills may reliably pass through said bill passageway into said bill slot, and from said bill slot outwardly through said bill passageway to said entrance during bill rejection.

12. The security cover of claim 11 wherein said plate is carried on an interior of said housing and includes a mask portion for protruding to an exterior of said housing; said entrance being disposed in said mask portion; and, said mask portion being constructed and arranged for covering said mouth portion of said bill validator to protect said bill slot.

13. The security cover of claim 11 wherein said bill passageway includes a first guide flange contoured upward and a second guide flange contoured downward from said entrance to said mouth portion so that bills rejected from said bill validator that do not extend directly out from said bill slot are deflected by said flanges through said bill passageway to said entrance to prevent bills from lodging between said plate and said bill validator.

14. The security cover of claim 11 including tamper resistant fasteners for affixing said plate to said housing to prevent access to said fasteners by the public.

15. The security cover of claim 11 wherein said plate has a height at least equal to said bill validator for protecting said bill validator from attempts to access said bill validator by breaking through said housing.

16. The security cover of claim 11 wherein said plate has a width at least equal to said bill validator for protecting said bill validator from attempts to access said bill validator by breaking through said housing.

* * * * *